United States Patent [19]

Ewig

[11] 4,155,498

[45] May 22, 1979

[54] STAPLER

[75] Inventor: John F. Ewig, Worcester, Mass.

[73] Assignee: Parker Manufacturing Company, Worcester, Mass.

[21] Appl. No.: 844,540

[22] Filed: Oct. 25, 1977

[51] Int. Cl.[2] ..... B25C 5/10
[52] U.S. Cl. ..... 227/132
[58] Field of Search ..... 227/132

[56] References Cited

U.S. PATENT DOCUMENTS

| | | | |
|---|---|---|---|
| 3,275,212 | 9/1966 | Johnson | 227/132 |
| 3,862,712 | 1/1975 | LaPointe | 227/132 X |

*Primary Examiner*—Roy Lake
*Assistant Examiner*—Paul A. Bell
*Attorney, Agent, or Firm*—Norman S. Blodgett; Gerry A. Blodgett

[57] ABSTRACT

Stapler having a vertically-adjustable cap for selecting a staple-driving force.

5 Claims, 3 Drawing Figures

STAPLER

BACKGROUND OF THE INVENTION

In the design and operation of stapling guns, it is desirable to be able to provide the gun with a selection of forces for driving the staples. Usually, the provision of a high and a low force is sufficient for most purposes. The high force is desirable when the staples are being driven into hard material and the low force is desirable for normal use, simply because it is much harder work to successfully compress the spring to the high force. It is desirable, then, to be able to use low force when it is possible. Various constructions have been used in the past to provide for this selection of driving forces, a stapler of this kind being shown in the U.S. patent of Johnson No. 3,275,212. These constructions of the past have been expensive and intricate and have not been adapted to construction by modern manufacturing methods. Furthermore, they have been difficult for a person of average strength to manipulate. These and other difficulties experienced with the prior art devices have been obviated in a novel manner by the present invention.

It is, therefore, an outstanding object of the invention to provide a stapler having a ready-operable means for changing the staple-driving force.

Another object of this invention is the provision of a stapler having a force-changing means which is simple in construction and which can be readily operated by a person of average strength.

A further object of the present invention is the provision of a dual-force stapler of rugged construction which is not easily rendered inoperative.

It is another object of the instant invention to provide a stapler which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a stapler having an elongated base adapted to carry a supply of staples and to feed them toward one end to be driven. An elongated housing extends at a right angle to the said base; it has a hammer movable longitudinally of the housing toward the said one end of the base to drive a staple. An elongated grip extends from the housing at a position spaced from the base and a trigger for actuating the hammer is hingedly fastened to the housing and extends in the same general direction as the base and grip. The spring in the housing presses with one end against the hammer. A cap with a transverse bore is slidably mounted between two spaced parallel walls of the housing for movement longitudinally thereof, while engaging the other end of the spring. The lifter is pivotally mounted on the trigger and has a hook at one end for engagement with the hammer. A pin extends through an aperture in one wall of the housing and has a cylindrical portion that fits snugly in the bore of the cap. The pin also has two non-coextensive cylindrical portions of substantially different diameter for selective engagement with the edge of the aperture.

More specifically, the pin extends along part of the length of the bore in the cap, the inner end of the pin having a longitudinal bore. A coil spring lies with one end in the bore and the other end pressing against the opposite wall of the housing to bias the pin outwardly of the aperture. Each of the two cylindrical portions is smaller in diameter than the aperture and the diameter of the aperture is smaller than that of the bore in the cap.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
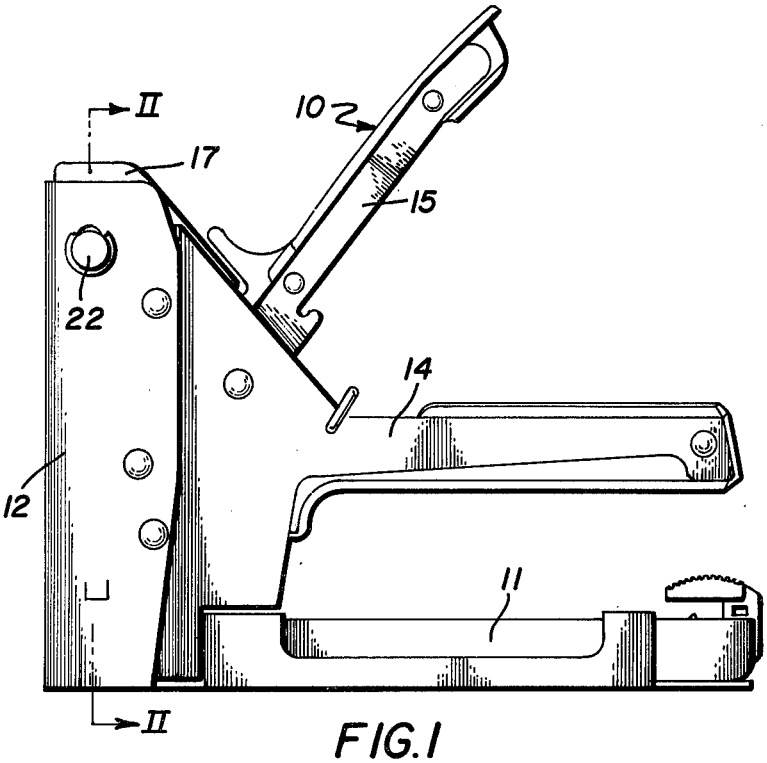
FIG. 1 is a side elevational view of a stapler incorporating the principles of the present invention.

Referring first to FIG. 1, wherein are best shown the general features of the invention, it can be seen that the stapler, indicated generally by the reference numeral 10, is provided with an elongated base 11, which is adapted to carry a supply of staples and to feed them toward one end. An elongated housing 12 extends at a right angle to the base 11, and has a hammer 13 (FIG. 2) movable longitudinally of the housing toward the said one end to drive a staple. An elongated grip 14 extends from the housing 12 at generally the mid-point and is, therefore, parallel to and spaced from the base 11. A trigger 15 for actuating the hammer is hingedly fastened to the housing and extends in the same general direction as the base and at an acute angle to the grip 14.

Figure 2:
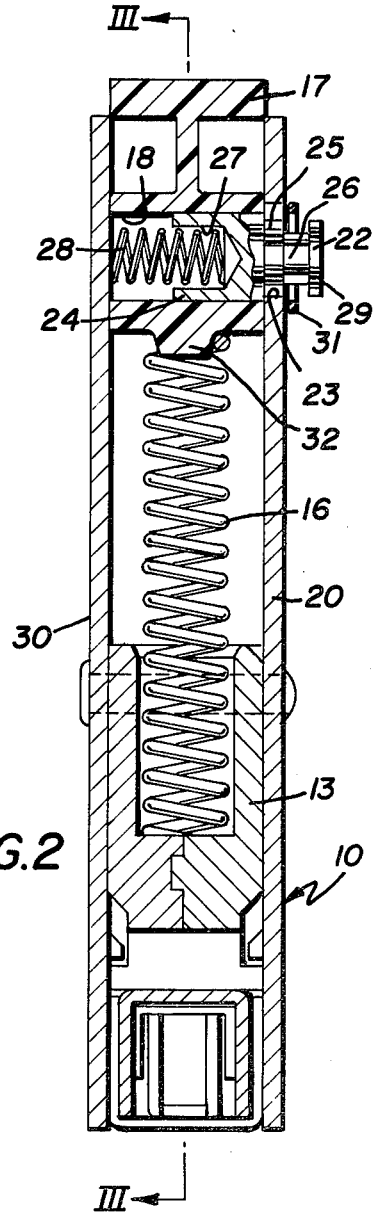
FIG. 2 is a vertical sectional view of the stapler taken on the line II—II of FIG. 1.
Figure 3:
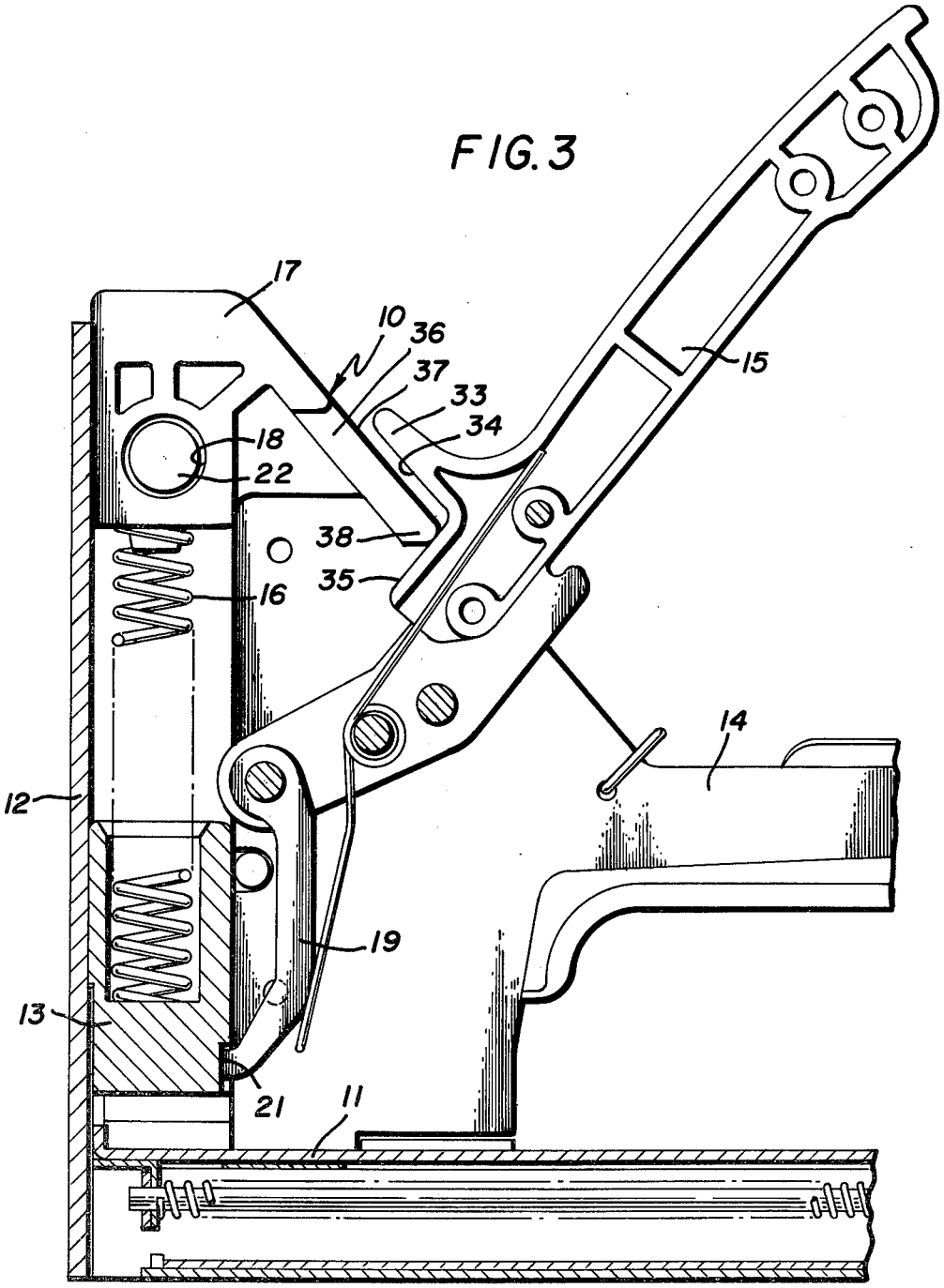
FIG. 3 is a vertical sectional view of the stapler taken on the line III—III of FIG. 2.

Referring to FIGS. 2 and 3, it can be seen that a coil spring 16 lies in the housing 12 and presses at one end against the hammer 13. A cap 17 is slidably mounted between two spaced parallel walls 20 and 30 of the housing 12 for movement longitudinally thereof on occasion. The cap engages the upper end of the spring 16 and has a transverse bore 18.

A lifter 19 is pivotally mounted on the trigger 15 and has a hook 21 at one end for engagement with the hammer. A pin 22 extends through an aperture 23 in the wall 20 of the housing and has a cylindrical portion 24 that fits snugly in the bore 18 in the cap 17. The cap also has two non-coextensive cylindrical portions 25 and 26 of substantially different diameters.

The pin 22 extends through only part of the length of the bore 18 and its inner end has a longitudinal bore 27 in which lies a coil spring 28. One end of the coil spring lies in the bore 27 and the opposite end of the spring presses against the inner surface of the wall 30 of the housing to bias the end 22 outwardly of the aperture 23. Each of the two cylindrical portions 25 and 26 is smaller in diameter than the aperture 23 and the diameter of the aperture 23 is smaller than that of the bore 18.

The outer end of the pin 22 is provided with a head 29 which is larger than the aperture 23, while a snap ring 31 lying around the smaller cylindrical portion 26 also assures that the pin cannot be pushed entirely through the aperture 23.

The cap 17 is formed of injection molded plastic and has an integral downwardly-extending peg 32 which receives the upper end of the spring 16. The trigger 15 is formed with a flange 33 that defines two surfaces that lie at right angle to each other. One surface 35 lies longitudinally of the trigger and the other surface 34 lies transversely thereof. The cap 17 is provided with a flange 36 having an inclined surface 37 that lies against the said outer other surface 34 when the cap is in the upper position (REG) of adjustment. The flange 36 also having a rounded end 38 that rests against the said one surface 35 when the cap is in its lower (HI) position of adjustment.

The operation of the apparatus will now be readily understood in view of the above description. The staples are inserted in the conventional manner into the base 11 and are pressed by a spring toward the end where an extension of the hammer drives the staple out of the base. The staple is operated in the conventional manner by pressing the base 11 against the surface where the stapling is to take place and then pressing the trigger 15 toward the grip 14. The stapler provides for dual compression which permits its use in various ways. When the pin 22 is in the REG position, it operates with light or medium duty staplers. When it is in the HI position, the stapler has sufficient power to drive larger staples. In either case, the driving can take place with one hand. To change the stapler's force when the cap 17 is in the upper or REG position, the power is changed from REG to HI simply by pressing down on the head until a click is heard. This occurs because the cylindrical portion 25 moves into the aperture 23 under the pressure of the coil spring 28. The spring 16 maintains the pin pressed against the upper edge of the aperture 23, but, because the cylindrical portion 25 is large, the cap remains in a lower or HI position. In order to return it to the REG position, it is necessary to push on the cap 17, while at the same time pressing on the pin 22. The pin slides in far enough so that by allowing the cap to rise slowly, the cylindrical portion 26 lies against the upper edge of the aperture 23. The cap is then in its upper position, which means that the spring 16 is under a lower compression and the force available for stapling is less. Generally speaking, the REG or regular drive should be used in stapling quarter inch, five-sixteenth inch, and three-eights inch staples in soft wood such as pine. The HI drive should be used for stapling in hard materials such as oak and when driving large staples like one-half inch and nine-sixteenth inch staples.

The advantages of the present invention will be readily understood in view of the above description. It can be seen that by use of a simple, inexpensive and rugged means, it is possible to shift from one driving force to another with a minimum of difficulty. Actually, driving staples with the HI force is harder to do; therefore, this force should be used only when necessary. Otherwise, the regular force should be used, so that the worker is subject to a less tiring operation. The use of the right angle surfaces 34 and 35 associated with the flange 33 of the trigger 15 (cooperating with the flange 36 of the cap with its surfaces 37 and rounded end 38) provide a simple means of limiting the upper movement of the trigger 15 and holding it locked in the same position at all times. It is possible, of course, with the trigger located above the grip 14 to provide the force necessary in the HI force condition of the stapler by pressing against the trigger, rather than by merely squeezing the trigger against the grip.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Stapler, comprising:

(a) an elongated base and adapted to carry a supply of staples and to feed them toward one end, (b) an elongated housing extending at a right angle to the said base and having a hammer movable longitudinally of the housing toward the said one end to drive a staple, (c) an elongated grip extending from the housing at a position spaced from the base, (d) a trigger for actuating the hammer hingedly fastened to the housing and extending in the same general direction as the base and grip, (e) a spring in the housing pressing with one end against the said hammer, (f) a cap slidably mounted between two spaced parallel walls of the housing for movement longitudinally thereof and engaging the other end of the spring, the cap having a transverse bore, (g) a lifter pivotally mounted on the trigger and having a hook at one end for engagement with the hammer, and (h) a pin extending through a circular aperture in one wall of the housing and having a cylindrical portion that fits snugly in the bore in the cap and has a larger diameter than the aperture, the pin also having two non-coextensive cylindrical portions of substantially different diameters, each of which is smaller than the diameter of the aperture, the pin also having a head which is larger than the aperture and lies outside of the aperture.

2. Stapler as recited in claim 1, wherein the pin only extends part of the length of the bore in the cap, the inner end of the pin having a longitudinal bore, and wherein a coil spring lies in the bore of the cap with one end in the bore of the pin and the other end pressing against the opposite wall of the housing to bias the pin outwardly of the aperture.

3. Stapler as recited in claim 1, wherein the cap is formed of injection molded plastic and has an integral downwardly-extending peg receiving the end of the spring.

4. Stapler as recited in claim 1, wherein the trigger is formed with a flange defining two surfaces that lie at a right angle to each other, one surface lying longitudinally of the trigger and the other transversely thereof, wherein the cap is provided with a flange having an inclined surface which lies against the said other surface when the cap is in its upper position of adjustment, and wherein the flange has a rounded end that rest against the said one surface when the cap is in its lower position of adjustment.

5. Stapler as recited in claim 1, wherein the trigger lies above the grip and is actuated to lift and release the hammer by pressing it against the grip.

* * * * *